United States Patent [19]

Holmes

[11] Patent Number: 5,030,885

[45] Date of Patent: Jul. 9, 1991

[54] CHARGED PARTICLE CONTROL DEVICE

[75] Inventor: Andrew J. T. Holmes, Abingdon, United Kingdom

[73] Assignee: United Kingdom Atomic Energy Authority, London, England

[21] Appl. No.: 396,644

[22] Filed: Aug. 22, 1989

[30] Foreign Application Priority Data

Aug. 26, 1988 [GB] United Kingdom ..... 8820359

[51] Int. Cl.[5] ..... H05H 1/24

[52] U.S. Cl. ..... 315/111.31; 315/111.21; 315/111.41; 315/111.81; 313/231.31; 250/423 R

[58] Field of Search ..... 315/111.31, 111.21, 315/111.41, 111.81; 313/231.31; 250/423 R, 492.3

[56] References Cited

U.S. PATENT DOCUMENTS

| | | | |
|---|---|---|---|
| 3,619,684 | 11/1971 | Andrew et al. | 315/111.31 |
| 3,955,091 | 5/1976 | Robinson et al. | 315/111.31 X |
| 4,149,055 | 4/1979 | Seliger et al. | 315/111.31 X |
| 4,531,077 | 7/1985 | Dagenhart | 315/111.41 X |
| 4,760,262 | 7/1988 | Sampayan et al. | 315/111.81 X |
| 4,841,197 | 6/1989 | Takayama et al. | 315/111.41 X |
| 4,857,809 | 8/1989 | Torii et al. | 315/111.31 |

FOREIGN PATENT DOCUMENTS

| | | |
|---|---|---|
| 0002726 | 11/1979 | European Pat. Off. . |
| 0200035 | 10/1986 | European Pat. Off. . |
| 447947 | 5/1936 | United Kingdom . |
| 945632 | 1/1964 | United Kingdom . |
| 1280012 | 7/1972 | United Kingdom . |
| 2065365 | 6/1981 | United Kingdom . |
| WO88/03742 | 5/1988 | World Int. Prop. O. . |

*Primary Examiner*—Eugene R. LaRoche
*Assistant Examiner*—Do Hyun Yoo
*Attorney, Agent, or Firm*—William R. Hinds

[57] ABSTRACT

A plasma source of charged particles includes a particle extraction control device consisting of an electrode having an exit hole in it and a planar solenoid arranged to produce, when energized, a magnetic field across the exit hole in the electrode, the magnitude of the magnetic field and potentials applied to extraction electrodes being variable so as to enable different charged particles to be emitted by the source.

8 Claims, 1 Drawing Sheet

CHARGED PARTICLE CONTROL DEVICE

FIELD OF THE INVENTION

The present invention relates to the production of charged particles and more specifically to the production of negatively charged particles.

BACKGROUND OF THE INVENTION

Negative particle sources consist of means for generating and containing a plasma to provide the charged particles, one or more extraction and accelerating electrodes and a magnetic selector for the particular type of charged particle which it is desired that the source should produce.

Hitherto, the magnetic selectors have taken the form of arrangements of permanent magnets. These have disadvantages in that not only are the field configurations produced by these magnets not ideal for the purpose of suppressing the emission of one type of charged particle in favour of another, but the value of the magnetic field cannot be changed readily, thus restricting any given source to the production of charged particles with a particular charge to mass ratio.

SUMMARY OF THE INVENTION

According to the invention there is provided a control device for varying the intensity of a beam of charged particles derived from a plasma, comprising an electrode having an extraction orifice therein, a planar solenoid arranged to produce when energised a planar magnetic field across the extraction orifice of an intensity such as to exclude at least partially the plasma from the region of the extraction electrode and means for creating an electric field such as to extract charged particles of a selected type from the plasma.

Also according to the present invention there is provided a source of charged particles comprising means for generating within a chamber a plurality of charged particles in the form of a plasma, means for selecting a desired species of charged particles from those produced within the chamber and means for extracting from the chamber and accelerating the selected charged particles, wherein the means for selecting the desired species of charged particles comprises a planar solenoid arranged to produce a magnetic field across an orifice in an extraction electrode associated with the chamber such as to exclude at least partially the plasma from the region of the extraction electrode and means for creating an electric field such as to extract charge particles of a selected type from the plasma.

The use of a solenoid to generate the magnetic field enables the shape of the magnetic field to be optimised and also for its magnitude to be varied easily so that the emission of electrons can be suppressed if it is desired to produce negative ion beams from the source, or the electron current can be modulated if the plasma is used as an electron emitting cathode.

Devices that use fast electrons (such as thyratrons or ignatrons) in a plasma as charge carriers are devices the action of which can be initiated by a trigger electrode but which cannot be turned off in the same way because the electron current flow sustains the plasma by continuous ionisation of the plasma medium. The use of a variable magnetic field to manipulate the plasma enables one to make or break electron current flows up to the kiloampere range and at frequencies up to in excess of 10 MHZ, hence producing devices analogous to the GTO thyristor. Alternatively, one can modulate electron flows with a low forward voltage drop in the "on" state, thus creating a high power device which is more analogous to the transistor than to a hard valve.

DESCRIPTION OF THE DRAWINGS

The invention will now be described, by way of example, with reference to the accompanying drawings, in which.

DESCRIPTION OF PREFERRED EMBODIMENTS

Figure 1:
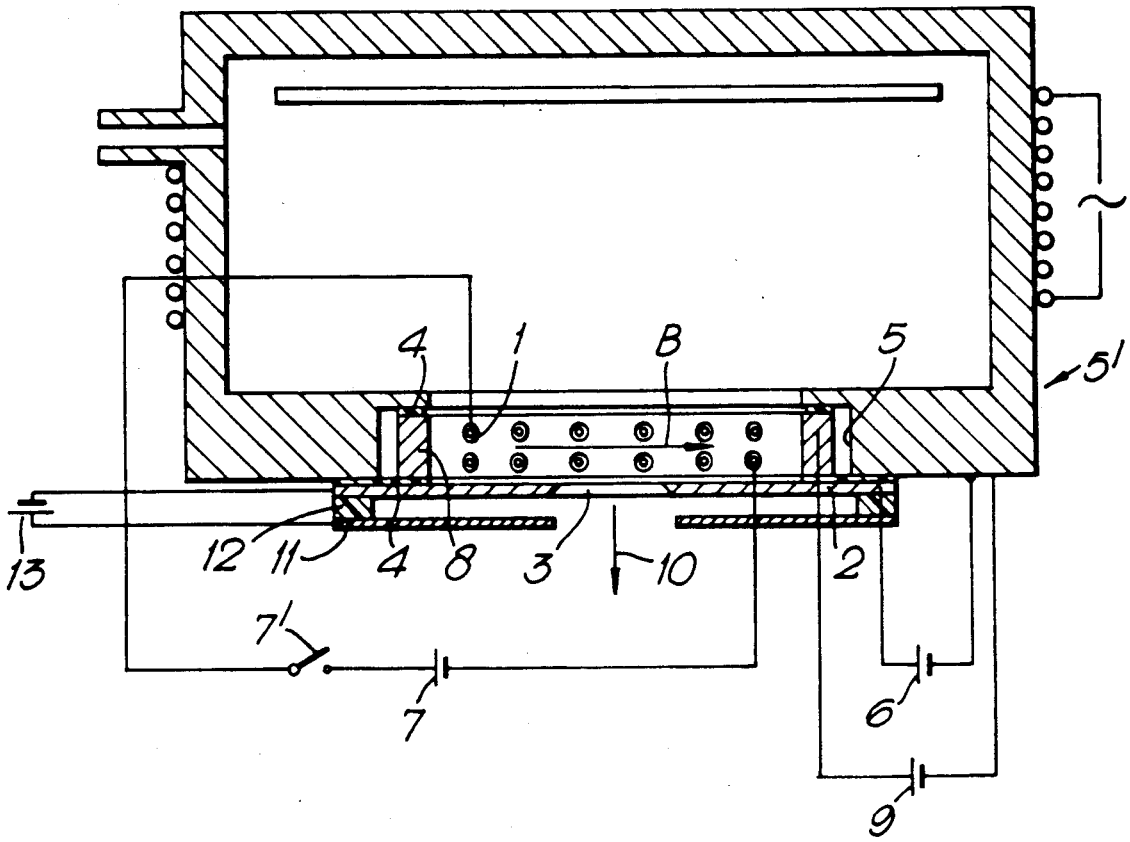
FIG. 1 shows an elevational view of plasma charged particle source embodying the invention.

Referring to the drawings, an electromagnetic control device for use in a charged particle source consists of a planar solenoid 1 which is supported by and electrically connected to an extraction electrode 2 which has a central orifice 3. The extraction electrode 2 is mounted on, but electrically insulated from, by means of mica sheet 4, an outer electrode 5 which forms part of a chamber of a r.f. plasma generator of known type indicated generally by the reference numeral 5'. The extraction electrode 2 is biassed with respect to the outer electrode 5 by means of a power source indicated conventionally as a battery 6. The solenoid 1 is energised by means of another power source 7 via a switch 7'. A collector ring 8 for electrons is biassed from the outer electrode 5 by a power supply 9. There is provided also an accelerating electrode 11 which is isolated from the extraction electrode 2 by an annular insulator 12. An electric field between the electrodes 2 and 11 is established by means of a power source 13, again shown conventionally as a battery.

In use, the solenoid 1 generates a sheet of magnetic field B when energised by the power supply 7 and this field is directed across the orifice 3 in the extraction electrode 2, as shown in FIG. 1. Depending on the magnitude of this magnetic field and the discharge gas the charged particle source will produce either a negatively charged ion beam or an electron beam 10.

Figure 2:
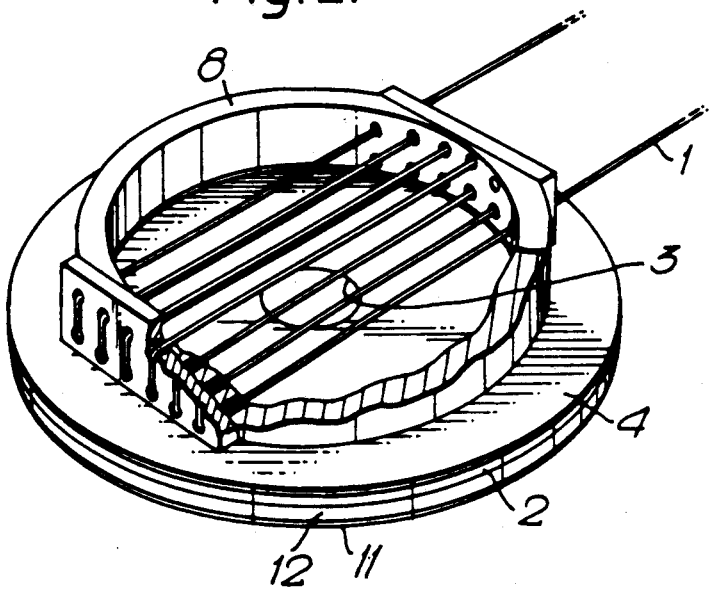
FIG. 2 is a perspective view of part of the embodiment of FIG. 1.

The control device described above has circular symmetry, as shown in FIG. 2, but this is not a required condition and the same principle can be used in conjunction with slit apertures.

The plasma within the chamber of the charged particle source provides an indestructible electron cathode which can move so that the charged particle emission current density matches a voltage $V_f$ applied across the gap $d_m$ between the extraction electrode 2 and the accelerating electrode 11. If, for example, the source is to provide a high density flow of electrons at a low forward voltage and the control device is to act as a switch, the gap between the two electrodes is made to be small ($\sim$1 cm) and a voltage of the order of tens of kilovolts is applied between the electrodes 2 and 11. To produce the "off", state, the solenoid 1 is fully energised to produce a magnetic field B in the direction shown of about 600 gauss over a depth of about 4 mm. This is sufficient to inhibit the flow of electrons from the plasma as they can only diffuse "classically" across the high magnetic field region. The electron current $j_e$ is given by the relation $$j_e = \frac{n_e V_e}{4} \cdot \frac{C}{(B^2 + C)}$$

where $n_e$ is the electron density, $V_e$ the electron velocity, C is a constant dependant upon the nature of the gas forming the plasma, typically hydrogen or deuterium, and B is the strength of the magnetic field. For deuterium, $C \sim 1400$. Under these circumstances the plasma boundary recedes from the gap between the electrodes to a distance $d_f$ from the accelerating electrode 11. The gap between the extraction electrode 2 and the accelerating electrode 11 will be clear of plasma if the mechanical distance between them $d_m < d_f$ for the value of $j_e$ existing when the magnetic field B is at its maximum strength.

To produce the 'on' state, the supply to the solenoid 1 is switched off. The plasma then moves forward into the gap between the extraction electrode 2 and the accelerating electrode 11 until the distance $d_f$ between the plasma boundary and the accelerating electrode 11 is established at a new value corresponding to the full electron current density the plasma source is capable of providing. The forward voltage drop $V_f$ in the 'on' state is determined by the series resistance R in the circuit of the accelerating electrode 11 and the total current flowing in the device. For example, if the plasma discharge current allows a forward current of about 1 k A and the supply voltage is 40 kV, a series resistance of about 40 Ω would reduce the forward voltage drop across the plasma electron source as a whole to a few tens of volts; merely that necessary to obtain the saturated electron flux from the plasma.

The switching time in either direction that the solenoid 1 is capable of achieving depends upon its inductance and the voltage applied to it. For example, to achieve a possible switching time of 10 nano seconds with a solenoid having an inductance of about $10^{-7}$ Henries and capable of producing a field of about 600 gauss, a drive voltage of about 2 k V would be required.

I claim:

1. A control device for varying the intensity of a beam of charged particles derived from a plasma, comprising an extraction electrode having an extraction orifice therein, a planar solenoid means for producing, when energised, a planar magnetic field across the extraction orifice of an intensity such as to exclude at least partially the plasma from the region of the extraction electrode, and means for creating an electric field such as to extract charged particles of a selected type from the plasma.

2. A control device according to claim 1 in association with means for producing within a chamber a plurality of charged particles in the form of a plasma.

3. A control device according to claim 1 wherein the planar solenoid means is capable of substantially excluding the plasma from the region of the extraction electrode thereby to act as a beam switch.

4. A control device according to claim 1 wherein the planar solenoid means modulates the beam of charged particles.

5. A control device according to claim 1 wherein the extraction orifice has circular symmetry.

6. A control device according to claim 1 wherein the extraction orifice is elongated.

7. A control device according to claim 2 wherein the planar solenoid means is capable of substantially excluding the plasma from the region of the extraction electrode thereby to act as a beam switch.

8. A control device according to claim 2 wherein the planar solenoid means modulates the beam of charged particles.

* * * * *